US005882505A

United States Patent [19]

Wittenbrink et al.

[11] Patent Number: 5,882,505

[45] Date of Patent: Mar. 16, 1999

[54] CONVERSION OF FISHER-TROPSCH WAXES TO LUBRICANTS BY COUNTERCURRENT PROCESSING

[75] Inventors: Robert J. Wittenbrink, Baton Rouge, La.; Stephen Mark Davis, Houston; Larry L. Iaccino, Friendswood, both of Tex.

[73] Assignee: Exxon Research and Engineering Company, Florham Park, N.J.

[21] Appl. No.: 868,394

[22] Filed: Jun. 3, 1997

[51] Int. Cl.[6] ..... C01G 65/10

[52] U.S. Cl. ..... 208/59; 27/28; 27/50; 27/60; 27/62

[58] Field of Search ..... 208/57, 58, 59, 208/89, 27, 28, 60, 62

[56] References Cited

U.S. PATENT DOCUMENTS

| | | | |
|---|---|---|---|
| 3,147,210 | 9/1964 | Hass et al. | 208/210 |
| 3,767,562 | 10/1973 | Sze et al. | 208/57 |
| 3,775,291 | 11/1973 | Sze et al. | 208/57 |
| 3,777,291 | 12/1973 | Sze et al. | 208/57 |
| 4,599,162 | 7/1986 | Yen | 208/59 |
| 5,183,556 | 2/1993 | Reilly et al. | 208/57 |
| 5,378,348 | 1/1995 | Davis et al. | 208/27 |
| 5,522,983 | 6/1996 | Cash et al. | 208/59 |

*Primary Examiner*—Helane Myers
*Attorney, Agent, or Firm*—Henry E. Naylor

[57] ABSTRACT

A process for converting Fischer-Tropsch wax streams to lubricants by reacting said stream with a dewaxing catalyst in a reaction zone where the stream flows countercurrent to upflowing hydrogen-containing treat gas.

17 Claims, No Drawings

CONVERSION OF FISHER-TROPSCH WAXES TO LUBRICANTS BY COUNTERCURRENT PROCESSING

FIELD OF THE INVENTION

The present invention relates to a process for converting Fischer-Tropsch wax streams to lubricants by reacting said stream with a dewaxing catalyst in a reaction zone where the stream flows countercurrent to upflowing hydrogen-containing treat gas.

BACKGROUND OF THE INVENTION

It is known to produce products, such as distillate fuels and lubes from waxy hydrocarbon feedstocks by catalytic hydrocracking, hydroisomerization, catalytic dewaxing, or a combination thereof. One source of waxy hydrocarbon feedstocks in the future will be from Fischer-Tropsch process units wherein a synthesis gas is reacted over a Group VI or VIII metal catalyst, then mildly hydroisomerized and/or mildly hydrocracked over a suitable catalyst to produce a distillate fuel, or refinery feedstock useful for conversion to a distillate fuel. In recently issued U.S. Pat. No. 5,378,348, good yields of distillate fuels with excellent cold flow properties are produced from waxy Fischer-Tropsch products via an improved fixed bed process wherein the waxy Fischer-Tropsch product is separated into 260° C. minus and 260° C. plus fractions and separately hydroisomerized to make middle distillates. The 260° C. minus fraction, e.g., 160° to 260° C. fraction, is hydrotreated in a first step at mild conditions over a suitable catalyst to remove heteroatoms, then hydroisomerized is a second step over a fixed bed of a Group VIII noble metal catalyst, suitably a platinum or palladium catalyst, to yield jet fuel and a light naphtha by-product. The heavier 260° C. plus fraction, on the other hand, is directly hydrocracked to produce a 160° to 370° C. fraction which is useful as a diesel or jet fuel, or as a blending component for diesel or jet fuel. While this process demonstrates the feasibility of producing distillates with improved cold flow properties from waxy hydrocarbons, there remains a need to provide further improvements in the hydroisomerization.

Further, when the Fischer-Tropsch waxy product is used for lubricating oils, it is necessary that substantially all of the wax be removed in order to achieve the desired low temperature properties. Catalytic and solvent dewaxing are the major processes used in the petroleum industry today for removing this wax. Catalytic dewaxing works by selectively cracking the waxy molecules over a zeolite catalyst. Presently available commercial catalytic dewaxing processes utilize a relatively small pore zeolite, such as a ZSM-5 containing catalyst. These zeolite catalysts are sensitive to water in the system which is formed from oxygenates in the feedstream. Consequently, it is preferred that the stream be first subjected to a heteroatom removal step prior to catalytic dewaxing and preferably prior to both hydroisomerization and catalytic dewaxing.

Heteroatoms such as sulfur, nitrogen, and oxygen are known catalyst poisons and their removal from petroleum feedstocks is often referred to as hydrotreating. Typically, catalytic hydroprocessing, which includes hydrotreating, hydroisomerization, and hydrodewaxing, of liquid-phase petroleum feedstocks is carried out in co-current reactors in which both a preheated liquid feedstock and a hydrogen-containing treat gas are introduced to the reactor at a point, or points, above one or more fixed beds of hydroprocessing catalyst. The liquid feedstock, any vaporized hydrocarbons, and hydrogen-containing treat gas, all flow in a downward direction through the catalyst bed(s). The resulting combined vapor phase and liquid phase effluents are normally separated in a series of one or more separator vessels, or drums, downstream of the reactor. Dissolved gases are normally removed from the recovered liquid stream by gas or steam stripping in yet another downstream vessel or vessels, or in a fractionator.

Conventional co-current catalytic hydroprocessing has met with a great deal of commercial success; however, it has limitations. For example, because of hydrogen consumption and treat gas dilution by light reaction products, hydrogen partial pressure decreases between the reactor inlet and outlet. At the same time, any reactions for removing heteroatoms, such as hydrodesulfurization and hydrodenitrogenation that take place results in increased concentrations of $H_2S$, $NH_3$, or oxygenates. These are all known to inhibit the activity and performance of hydroprocessing catalysts through competitive adsorption on the catalyst. Thus, the downstream portion of catalyst in a conventional co-current reactor is often limited in reactivity because of the simultaneous occurrence of multiple negative effects, such as low $H_2$ partial pressure and the presence of high concentrations of heteroatom components. Further, liquid phase concentrations of the targeted hydrocarbon reactants are also the lowest at the downstream part of the catalyst bed. Also, because kinetic and thermodynamic limitations can be severe, particularly at deep levels of heteroatom removal, higher reaction temperatures, higher treat gas rates, higher reactor pressures, and often higher catalyst volumes are required. Multistage reactor systems with stripping of heteroatom-containing species between reactors and additional injection of fresh hydrogen-containing treat gas are often employed, but they have the disadvantage of being equipment intensive processes.

Another type of hydroprocessing is countercurrent hydroprocessing which has the potential of overcoming many of these limitations, but is presently of very limited commercial use today. U.S. Pat. No. 3,147,210 discloses a two stage process for the hydrofining-hydrogenation of high-boiling aromatic hydrocarbons. The feedstock is first subjected to catalytic hydrofining, preferably in co-current flow with hydrogen, then subjected to hydrogenation over a sulfur-sensitive noble metal hydrogenation catalyst countercurrent to the flow of a hydrogen-containing treat gas. U.S. Pat. Nos. 3,767,562 and 3,775,291 disclose a countercurrent process for producing jet fuels, whereas the jet fuel is first hydrodesulfurized in a co-current mode prior to two stage countercurrent hydrogenation. U.S. Pat. No. 5,183,556 also discloses a two stage co-current/countercurrent process for hydrofining and hydrogenating aromatics in a diesel fuel stream.

While the state of the art relating to producing distillate fuels and lubricant products from Fischer-Tropsch waxes has advanced rapidly over the past decade, there is still a substantial need in the art for ever improved efficient processes for achieving same.

SUMMARY OF THE INVENTION

In accordance with the present invention there is provided a process for converting waxy feedstock boiling in exess of 370° C. to lubricants, which process comprises:

hydroisomerizing said feedstock in a reaction zone containing a fixed bed of hydroisomerization catalyst, in the presence of a hydrogen-containing treat gas, and operated under hydroisomerization conditions;

hydrodewaxing the hydroisomerized feedstock in a reaction zone containing a fixed bed of hydrodewaxing catalyst and operated under hydrodewaxing conditions wherein the hydroisomerized feedstock flows countercurrent to upflowing hydrogen-containing treat gas.

In a preferred embodiment of the present invention the hydroisomerization reaction zone is also operated in countercurrent mode.

In other preferred embodiments of the present invention at least one of the hydroisomerization zones is a co-current reaction zone wherein said feed stream flows co-current to the flow of a hydrogen-containing treat gas.

In another preferred embodiment of the present invention, there is provided at least one co-current hydrotreating zone followed by at least one countercurrent hydroisomerization zones followed by at least one countercurrent hydrodewaxing zone.

DETAILED DESCRIPTION OF THE INVENTION

Feedstocks suitable for use in the practice of the present invention are waxy feedstocks boiling above about 370° C. It is preferred that the feedstock be a Fischer-Tropsch waxy stream, although a slack wax may also be used. The Fischer-Tropsch waxy product results from a process wherein a synthesis gas mixture of carbon monoxide and hydrogen are converted to predominantly aliphatic straight-chain hydrocarbons and oxygenated derivatives. Slack waxes are the by-products of dewaxing operations where a diluent such as propane or a ketone (e.g., methylethyl ketone, methylisobutyl ketone) or other diluent is employed to promote wax crystal growth, the wax being removed from the lubricating oil base stock by filtration or other suitable means. The slack waxes are generally paraffinic in nature, boil above about 325° C., preferably in the range of about 315° C. to about 565° C., and may contain from about 1 to about 35 wt. % oil. Waxes with low oil contents, e.g., 5–20% are preferred, however, waxy distillates or raffinates containing 5–45 wt. % wax may also be used as the feed. Slack waxes are usually freed of polynuclear aromatics and heteroatom components by techniques known in the art; e.g., mild hydrotreating as described in U.S. Pat. No. 4,900,707, which also reduces sulfur and nitrogen levels, preferably to less than about 5 ppm and less than 2 ppm respectively. Fischer-Tropsch waxes are the preferred feed materials, having negligible amounts of aromatics, sulfur, and nitrogen compounds.

In hydroisomerization operation, total conversion of the 370° C.+ feed to produce a 370° C.$^-$ product, based on the weight of the feed, is maintained at a level ranging from about 30 wt. % to about 90 wt. %, preferably from about 30 wt. % to about 50 wt. % on a once-through, or fresh feed basis.

Hydroisomerization is typically used to produce distillate fuels and lubes with good cold flow properties in good yield from $C_5$+ paraffinic, or waxy hydrocarbon feeds, by contacting and reacting the stream with a hydrogen-containing gas over a small particle size hydroisomerization catalyst dispersed, or slurried, in a paraffinic or waxy liquid medium. The hydroisomerization reaction of the present invention is conducted at conditions predominantly lubricants. In general, the hydroisomerization reaction is conducted at temperatures ranging from about 200° C. to about 450° C., preferably from about 260° C. to about 370° C., and at pressures ranging generally from about 100 psig to about 1500 psig, preferably from about 300 psig to about 1000 psig. The reaction is generally conducted at hydrogen treat gas rates ranging from about 1000 SCFB to about 10,000 SCFB, preferably from about 2000 SCFB to about 5000 SCFB (standard cubic feet per barrel). Space velocities range generally from about 0.5 LHSV to about 20 LHSV, preferably from about 2 LHSV to about 10 LHSV (liquid hourly space velocity).

Hydroisomerization catalysts suitable for use herein will typically be bifunctional. That is, containing an active metal hydrogenation component or components, and a support component, which will preferably be acidic. The active metal component is preferably one or more metals selected from Groups IB, VIB, and VIII of the Periodic Table of the Elements (Sargent-Welch Scientific Company, Copyright 1968) in an amount sufficient to be catalytically active for hydroisomerization. Generally, metal concentrations range from about 0.05 wt. % to about 20 wt. % based on the total weight of the catalyst, preferably from about 0.1 wt. % to about 10 wt. %. Exemplary of such metals are such non-noble Group VIII metals as nickel and cobalt, or mixtures of these metals with each other or with other metals, such as copper, a Group IB metal, or molybdenum, a Group VIB metal. Palladium is exemplary of a suitable Group VIII noble metal. The metal, or metals, is incorporated with the support component of the catalyst by known methods, e.g., by impregnation of the support with a solution of a suitable salt or acid of the metal, or metals, drying and calcination.

The catalyst support is preferably selected from constituted of metal oxide, more preferably wherein at least one component is an acidic oxide which is active for producing olefin cracking and hydroisomerization reactions. Preferred oxides include silica, silica-alumina, clays, e.g., pillared clays, magnesia, titania, zirconia, halides, e.g., chlorided alumina, and the like. The catalyst support is more preferably comprised of silica and alumina, a particularly preferred support being constituted of up to about 25 wt. % silica, preferably from about 2 wt. % to about 35 wt. % silica, and having the following pore structural characteristics:

| Pore Radius, Å | Pore Volume |
|---|---|
| 0–300 | >0.03 ml/g |
| 100–75,000 | <0.35 ml/g |
| 0–30 | <25% of the vol. of the pores with 0–300 Å radius |
| 100–300 | <40% of the vol. of the pores with 0–300 Å radium |

The base silica and alumina materials can be, e.g., soluble silica containing compounds such as alkali metal silicates (preferably where $Na_2O:SiO_2$=1:2 to 1:4), tetraalkoxy silane, orthosilic acid ester, etc.; sulfates, nitrates, or chlorides of aluminum alkali metal aluminates; or inorganic or organic salts of alkoxides or the like. When precipitating the hydrates of silica or alumina from a solution of such starting materials, a suitable acid or base is added and the pH is set within a range of about 6.0 to 11.0. Precipitation and aging are carried out, with heating, by adding an acid or base under reflux to prevent evaporation of the treating liquid and charge of pH. The remainder of the support producing process is the same as those commonly employed, including filtering, drying and calcination of the support material. The support may also contain small amounts, e.g., 1–30 wt. % of materials such as magnesia, titania, zirconia, hafnia, and the like.

Support materials and their preparations are described more fully in U.S. Pat. No. 3,843,509 which is incorporated wherein by reference. The support materials generally have a surface area from about 180–400 $m^2/g$, preferably from about 230–375 $m^2/g$, a pore volume generally from about 0.3 to 1.0 ml/g, preferably from about 0.5 to 0.95 ml/g, a bulk density from about 0.5 to 1 g/ml, and a side crushing strength of about 0.8 to 3.5 kg/mm.

As previously mentioned, because the desired end product is for use as a component of a lubricating oil, the hydroisomerized stream will be subjected to catalytic dewaxing. Catalytic dewaxing, which is also referred to as "hydrodewaxing" is useful for reducing the pour point of a wide variety of hydrocarbon oil feedstocks ranging from light distillate fraction up to high boiling feedstocks, such as whole crude petroleum, reduced crudes, vacuum tower gas oils, etc. It is particularly useful for treating waxy distillate stocks, such as gas oils, kerosenes, jet fuels, lubricating oil stocks, hydrotreated oil stock and more preferably a Fischer-Tropsch reaction product.

It is preferred that the hydroisomerized stream be subjected to catalytic dewaxing, which is also sometimes referred to herein as "hydrodewaxing" to reduce the pour point. Non-limiting catalytic dewaxing catalysts will preferably be comprised of about 0.5 to 30 wt. %, based on the total weight of the catalyst, of a metal oxide of a Group VIII metal and an oxide of a Group VIB metal, supported on a porous support comprising a matrix containing about 50 to about 95 wt. % of a crystalline aluminosilicate zeolite, based on the weight of the support and having a modified surface. Any conventional shape selective zeolite which can be used to selectively crack normal paraffins in a heavy hydrocarbon stream can be used in the practice of the present invention. Such zeolites include the ZSM-type, SAPOs, the faujasites, zeolite beta, mordenite, and L-zeolites. The term "ZSM-type" zeolites is generally employed in the art to refer to those zeolites denominated by the nomenclature "ZSM-n" where "n" is an integer. The ZSM-type zeolites include, but are not limited to ZSM-5, ZSM-11, ZSM-12, ZSM-23, ZSM-35, ZSM-38, ZSM-48, and other other isomorphous substitute materials, such as [B], [Ga] and [Fe]-ZSM-5. The SAPO type zeolites are described in U.S. Pat. No. 4,960,504 which is incorporated herein by reference. Group VIB and Group VIII as referred to herein are of the Periodic Table of the Elements. The Periodic Table of the Elements referred to herein is found on the inside cover of the *CRC Handbook of Chemistry and Physics,* 55th Ed. (1974–75). ZSM-5, ZSM-11, ZSM-12, ZSM-23, ZSM-35 and ZSM-38 are described in U.S. Pat. Nos 3,702,886; 3,832,449; 4,076,842; 4,016,245; and 4,046,859 respectively, all of which are incorporated herein by reference. The most preferred catalysts are the ZSM and SAPO types, particularly ZSM-23 and SAPO-11.

The support utilized in preparing the dewaxing catalyst used in the practice of the present invention comprises a matrix or binder together with the above-described crystalline aluminosilicate zeolite. A wide variety of matrix materials which are resistant to the temperature and other conditions employed in this process can be used. Usually, the support will comprise about 50 to about 99 wt. %, preferably from about 65 to about 85 wt. % of the ZSM-5 type zeolite, based on the weight of the support, with the balance being a suitable matrix material. Non-limiting examples of such matrix materials include inorganic materials such as clays, silica, silica-alumina, and/or metal oxides, including mixed metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia, and Florida clays or others in which the main mineral constituent is halloysite, kaolinite, dickite, macrite, or anauxide. Such clays can be used in the raw state as originally mined or initially subjected to calcination, acid treatment, or chemical modification.

In addition to the foregoing materials, the pentasil type zeolites employed herein to prepare the catalyst composition used in the practice of the present invention may be composited with a porous matrix material, such as alumina, silica-alumina, silica-magnesia, silica-zirconia, silica-thoria, silcia-beryllia, silica-titania as well as ternary compositions, such as silica-alumina-thoria, silica-alumina-zirconia, silica-alumina-magnesia, and silica-magnesia-zirconia.

Generally, the hydrodewaxing reaction zone will be operated at a temperature from about 200° C. to about 480° C., preferably from about 260° C. to 370° C.; at a liquid hourly space velocity (LHSV) of about 0.1 to about 10, preferably from about 0.5 to about 4; at a pressure of about 100 to about 2000 psig, preferably at about 300 to about 1000 psig, and at a hydrogen circulation rate of about 1000 to about 15,000 standard cubic feet per barrel (SCFB), preferably from about 2000 to about 4000 SCFB.

In preparing the dewaxing catalyst, the support is impregnated via conventional means known to those skilled in the art with the requisite amount of the metal compound or compounds which will provide on the support of the finished catalyst after calcination an oxide or a Group VIII metal and an oxide or a Group VIB metal. The finished catalyst will comprise from about 0.5 wt. % to about 30 wt. %, preferably from about 1 to about 15 wt. % of the metal oxides on the support, based on the total weight of the catalyst. The Group VIII metal may be iron, cobalt, or nickel which is loaded on the support, for example, as an about 0.5 to about 30 wt. %, preferably from about 3 to 15 wt. % of an aqueous solution of metal nitrate. The preferred metal of this group is nickel which may be employed as an about 0.5 to about 34 wt. % aqueous solution of nickel nitrate hexahydrate.

Polymeric oxoanions formed by the condensation of two different oxoanions are known as heteropolyanions. Oxoanions of acidic elements such as Mo, W, V, Nb, and Ta present in aqueous solution polymerize to form polyanions at low pH. Free acids or acid forms of this type are called heteropoly acid. Heteropoly acids such as those formed with Group VIB metals, as exemplified by tungsten and molybdenum, are employed in preparing the catalysts utilized in the practiced of this invention.

The feedstocks of the present invention, which are preferably Fischer-Tropsch waxes, are subjected to countercurrent hydrodewaxing in at least one catalyst bed, or reaction zone, wherein feedstock flows countercurrent to the flow of a hydrogen-containing treat gas. Typically, the reaction vessel used in the practice of the present invention will be comprised of one or more reaction zones wherein each reaction zone contains a suitable catalyst for the intended reaction and wherein each reaction zone is immediately preceded and followed by a non-reaction zone where products can be removed and/or feed or treat gas introduced. The non-reaction zone will be an empty (with respect to catalyst) horizontal cross section of the reaction vessel of suitable height.

If the feedstock contains unacceptably high levels of heteroatoms, such as sulfur, nitrogen, or oxygen, it can first be subjected to hydrotreating. In such cases, it is preferred that the first reaction zone be one in which the liquid feed stream flows co-current with a stream of hydrogen-containing treat gas through a fixed-bed of suitable hydrotreating catalyst. The term "hydrotreating" as used herein refers to processes wherein a hydrogen-containing treat gas is used in the presence of a catalyst which is primarily active for the removal of heteroatoms, including some metals removal, with some hydrogenation activity. When the feedstock is a Fischer-Tropsch reaction product stream, the most troublesome heteroatom species which need to be removed are oxygenates. The feedstock may have been previously hydrotreated in an upstream operation or hydrotreating may not be required if the feed stream already contains a low level of heteroatoms.

Suitable hydrotreating catalysts for use in the present invention are any conventional hydrotreating catalyst and includes those which are comprised of at least one Group VIII metal, preferably Fe, Co and Ni, more preferably Co and/or Ni, and most preferably Ni; and at least one Group VI metal, preferably Mo and W, more preferably Mo, on a high surface area support material, preferably alumina. Other suitable hydrotreating catalysts include zeolitic catalysts, as well as noble metal catalysts where the noble metal is selected from Pd and Pt. It is within the scope of the present invention that more than one type of hydrotreating catalyst be used in the same bed. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group VIII metal would mean that 20 g. of Group VIII metal was on the support. Typical hydroprocessing temperatures will be from about 100° C. to about 450° C. at pressures from about 50 psig to about 2,000 psig, or higher. If the feedstock contains relatively low levels of heteroatoms, then the co-current hydrotreating step can be eliminated and the feedstock can be passed directly to the hydroisomerization zone.

At least one of the reaction zones downstream of an initial co-current hydrotreating reaction zone will be run in countercurrent mode. That is, the liquid hydrocarbon stream will flow downward and a hydrogen-containing gas will flow upward.

It will be understood that the treat-gas need not be pure hydrogen, but can be any suitable hydrogen-containing treat-gas. It is preferred that the countercurrent flowing hydrogen treat-rich gas be cold make-up hydrogen-containing treat gas, preferably hydrogen. The countercurrent contacting of the liquid effluent with cold hydrogen-containing treat gas serves to effect a high hydrogen partial pressure and a cooler operating temperature, both of which are favorable for shifting chemical equilibrium towards saturated compounds. The liquid phase will typically be a mixture of the higher boiling components of the fresh feed. The vapor phase will typically be a mixture of hydrogen, heteroatom impurities, and vaporized liquid products of a composition consisting of light reaction products and the lower boiling components in the fresh feed. The vapor phase in the catalyst bed of the downstream reaction zone will be swept upward with the upflowing hydrogen-containing treat-gas and collected, fractionated, or passed along for further processing. It is preferred that the vapor phase effluent be removed from the non-reaction zone immediate upstream (relative to the flow of liquid effluent) of the countercurrent reaction zone. If the vapor phase effluent still contains an undesirable level of heteroatoms, it can be passed to a vapor phase reaction zone containing additional hydrotreating catalyst and subjected to suitable hydrotreating conditions for further removal of the heteroatoms. It is to be understood that all reaction zones can either be in the same vessel separated by non-reaction zones, or any can be in separate vessels. The non-reaction zones in the later case will typically be the transfer lines leading from one vessel to another. It is also within the scope of the present invention that a feedstock which already contains adequately low levels of heteroatoms fed directly into a countercurrent hydroprocessing reaction zone. If a preprocessing step is performed to reduce the level of heteroatoms, the vapor and liquid are disengaged and the liquid effluent directed to the top of a countercurrent reactor. The vapor from the preprocessing step can be processed separately or combined with the vapor phase product from the countercurrent reactor. The vapor phase product(s) may undergo further vapor phase hydroprocessing if greater reduction in heteroatom and aromatic species is desired or sent directly to a recovery system. The catalyst may be contained in one or more beds in one vessel or multiple vessels. Various hardware i.e. distributors, baffles, heat transfer devices may be required inside the vessel(s) to provide proper temperature control and contacting (hydraulic regime) between the liquid, vapors, and catalyst. Also, cascading and liquid or gas quenching may also be used in the practice of the present, all of which are well known to those having ordinary skill in the art.

In another embodiment of the present invention, the feedstock can be introduced into a first reaction zone co-current to the flow of hydrogen-containing treat-gas. The vapor phase effluent fraction is separated from the liquid phase effluent fraction between reaction zones; that is, in a non-reaction zone. The vapor phase effluent can be passed to additional hydrotreating, or collected, or further fractionated and sent to an aromatics reformer for the production of aromatics. The liquid phase effluent will then be passed to the next downstream reaction zone, which will preferably be a countercurrent reaction zone. In other embodiments of the present invention, vapor or liquid phase effluent and/or treat gas can be withdrawn or injected between any reaction zones.

The countercurrent contacting of an effluent stream from an upstream reaction zone, with hydrogen-containing treat gas, strips dissolved heteroatom impurities from the effluent stream, thereby improving both the hydrogen partial pressure and the catalyst performance. That is, the catalyst may be on-stream for substantially longer periods of time before regeneration is required. Further, higher heteroatom removal levels will be achieved by the process of the present invention.

What is claimed is:

1. A process for converting waxy feedstock boiling in excess of 370° C. to lubricants, which process comprises:

hydroisomerizing said feedstock in at least one reaction zone containing a fixed bed of hydroisomerization catalyst, in the presence of a hydrogen-containing treat gas, and operated under hydroisomerization conditions;

hydrodewaxing the hydroisomerized feedstock in at least one reaction zone containing a fixed bed of hydrodewaxing catalyst and operated under hydrodewaxing conditions wherein the hydroisomerized feedstock flows countercurrent to upflowing hydrogen-containing treat gas.

2. The process of claim 1 wherein the feedstock is a Fischer-Tropsch reaction product.

3. The process of claim 1 wherein hydroisomerization conditions include temperatures from about 200° C. to about 450° C. and pressures from about 100 to 1500 psig.

4. The process of claim 1 wherein the hydroisomerization catalyst is comprised of one or more metals from Groups IB, VIB, and VIII of the Periodic Table of the Elements on a suitable support.

5. The process of claim 4 wherein the metal concentration ranges from about 0.05 wt. % to about 20 wt. % based on the total weight of the catalyst.

6. The process of claim 5 wherein the catalyst contains at least one Group VIII metal, and at least one Group IB or Group VIB metal.

7. The process of claim 6 wherein the Group VIII metal is palladium.

8. The process of claim 6 wherein the Group VIII metal is selected from nickel and cobalt or a mixture thereof, and the Group IB metal is copper.

9. The process of claim 6 wherein the metal concentration of the catalyst ranges from about 0.1 wt. % to about 10 wt. %.

10. The process of claim 1 wherein the hydrodewaxing conditions include temperatures from about 200° C. to about 480° C. and pressures from about 100 to about 2000 psig.

11. The process of claim 10 wherein the hydrodewaxing catalysts is comprised of about 0.5 to 30 wt. %, based on the total weight of the catalyst, of a metal oxide of a Group VIII metal and an oxide of a Group VIB metal, supported on a porous support, comprising a matrix containing about 50 to about 95 wt. % of a pentasil type crystalline aluminosilicate zeolite.

12. The process of claim 11 wherein the dewaxing catalyst contains a zeolitic component selected from the group consisting of the ZSMs, SAPOs, faujasitess, zeolite beta, mordenite, [B], [Ga] and [Fe]-ZSM-5.

13. The process of claim 12 wherein the zeolite is selected from the group consisting of ZSM-5, ZSM-11, ZSM-12, ZSM-23, ZSM-35, ZSM-38, and SAPO-11.

14. The process of claim 13 wherein the hydroisomerization conditions include temperatures from about 200° C. to about 450° C and pressures from about 100 to 1500 psig; the hydroisomerization catalyst is comprised of one or more metals from Groups IB, VIB, and VIII of the Periodic Table of the Elements on a suitable support; and the metal concentration ranges from about 0.05 wt. % to about 20 wt. % based on the total weight of the catalyst.

15. The process of claim 14 wherein the feedstock is a Fischer-Tropsch reaction product.

16. The process of claim 1 wherein at least one hydroisomerization zone is operated in a co-current mode and the hydrodewaxing reaction zones are operated in countercurrent mode.

17. The process of claim 1 wherein there is at least one co-current hydrotreating zone followed by at least one countercurrent hydroisomerization zones followed by at least one countercurrent hydrodewaxing zone.

* * * * *